US008747646B2

(12) United States Patent
Fischer et al.

(10) Patent No.: US 8,747,646 B2
(45) Date of Patent: Jun. 10, 2014

(54) PROCESS FOR THE ANODIC CROSS-DEHYDRODIMERIZATION OF ARENES

(75) Inventors: Andreas Fischer, Heppenheim (DE); Itamar Michael Malkowsky, Hassloch (DE); Florian Stecker, Mannheim (DE); Siegfried R. Waldvogel, Bonn (DE); Axel Kirste, Swisttal (DE)

(73) Assignee: BASF SE, Ludwigshafen (DE)

( * ) Notice: Subject to any disclaimer, the term of this patent is extended or adjusted under 35 U.S.C. 154(b) by 251 days.

(21) Appl. No.: 13/375,495

(22) PCT Filed: Jun. 1, 2010

(86) PCT No.: PCT/EP2010/057617
§ 371 (c)(1),
(2), (4) Date: Dec. 1, 2011

(87) PCT Pub. No.: WO2010/139685
PCT Pub. Date: Dec. 9, 2010

(65) Prior Publication Data

US 2012/0080320 A1 Apr. 5, 2012

(30) Foreign Application Priority Data

Jun. 5, 2009 (EP) ..... 09162074

(51) Int. Cl.
*C25B 3/10* (2006.01)
*C25B 3/00* (2006.01)
*C25B 3/02* (2006.01)

(52) U.S. Cl.
USPC ..... 205/418; 205/416; 205/450; 205/452; 205/453; 205/463

(58) Field of Classification Search
USPC ..... 205/418, 450, 452, 453, 463, 416
See application file for complete search history.

(56) References Cited

U.S. PATENT DOCUMENTS

| | | | | |
|---|---|---|---|---|
| 3,271,278 | A * | 9/1966 | Baizer | 205/415 |
| 4,101,391 | A | 7/1978 | Hallcher | 204/59 R |
| 8,449,755 | B2 * | 5/2013 | Fischer et al. | 205/418 |
| 2011/0147228 | A1 | 6/2011 | Fischer et al. | 205/418 |
| 2012/0067736 | A1 * | 3/2012 | Stecker et al. | 205/418 |

FOREIGN PATENT DOCUMENTS

| | | | |
|---|---|---|---|
| DE | 27 00 152 | 7/1977 | |
| DE | 196 41 344 | 4/1997 | |
| EP | 08163356.2 | 9/2008 | |
| WO | 2006 077204 | 7/2006 | |
| WO | WO 2006077204 A2 * | 7/2006 | C25B 3/10 |
| WO | WO 2010/023258 A1 | 3/2010 | |

OTHER PUBLICATIONS

Kirste et al., "ortho-Selective Phenol-Coupling Reaction by Anodic Treatment on Boron-Doped Diamond Electrode Using Fluorinated Alcohols" (Jan. 29, 2009), Chem. Eur. J., vol. 15, pp. 2273-2277.*
U.S. Appl. No. 13/316,864, filed Dec. 12, 2011, Aust, et al.
Lukas J. Gooβen, et al., "Synthesis of Biaryls via Catalytic Decarboxylative Coupling", Science, vol. 313, Aug. 4, 2006, pp. 662-664.
David R. Stuart, et al., "The Catalytic Cross-Coupling of Unactivated Arenes", Sicence, vol. 316, May 25, 2007, pp. 1172-1175.
Alexandre Jean, et al., "Novel Method of Aromatic Coupling between N-Aryl Methanesulfonamide and Thiophene Derivatives", Organic Letters, vol. 9, No. 13, 2007, pp. 2553-2556.
Ruoshi Li, et al., "Intermolecular Cross-Coupling of Simple Arenes via C-H Activation by Tuning Concentrations of Arenes and TFA", Organometallics, vol. 25, No. 26, 2006, pp. 5973-5975.
Timothy A. Dwight., C-C Bond Formation via Double C-H Functionalization: Aerobic Oxidative Coupling as a Method for Synthesizing Heterocoupled Biaryls, Organic Letters, vol. 9, No. 16, 2007, pp. 3137-3139.
Kami L. Hull, et al., "Catalytic and Highly Regioselective Cross-Coupling of Aromatic C-H Substrates", J. Am. Chem. Soc., vol. 129, No. 39, 2007, pp. 11904-11905.
Toshifumi Dohi, et al., "A Chiral Hypervalent Iodine(III) Reagent for Enantioselective Dearomatization of Phenols", Angewandte Chemie Int. Ed., vol. 47, 2008, pp. 3787-3790.
Giovanni Sartori, et al., "Oxidative Coupling of Dichloroaluminium Phenolates: Highly Selective Synthesis of Hydroxylated Bi- and Tetraaryls", Tetrahedron, vol. 48, No. 43, 1992, pp. 9483-9494.
Martin Smrčina, et al., "Selective Cross-Coupling of 2-Naphthol and 2-Naphthylamine Derivatives. A Facile Synthesis of 2, 2',3-Trisubstituted and 2, 2', 3, 3'-Tetrasubstituted 1, 1'-Binaphthyls", J. Org. Chem., vol. 59, No. 8, 1994, pp. 2156-2163.
Kuiling Ding, et al., "Novel two-phase oxidative cross-coupling of the two-component molecular crystal of 2-naphthpol and 2-napthylamine", Chem. Commun., 1997, pp. 693-694.
Štěpán Vyskočil, et al., On the 'Novel two-phase oxidative cross-coupling of the two-component molecular crystal of 2-naphthol and 2-naphthylamine', Chem. Commun., 1998, pp. 585-586.
Axel Kirste, et al., "Anodic Preparation of Biphenols on BDD electrodes", 59th Annual Meeting of the International Society of Electrochemistry, Sep. 7-12, 2008, Spain, 1 pg.
"Ullmann's Encyclopedia of Industrial Chemistry, 2005, electronic release, Wiley-VCH-Weinheim, Electrochemistry (doi: 10.1002/14356007.a09_183), Chapter 3.5 (special cell designs) and Chapter 5.4.3.2 (Cell Design)"pp. 1-2, 29-34, 99-103.
Kirste, A., et al., "*ortho*-Selective Phenol-Coupling Reaction by Anodic Treatment on Boron-Doped Diamond Electrode Using Fluorinated Alcohols," Chem. Eur. J., vol. 15, pp. 2273-2277, (Jan. 29, 2009) XP002595229.
Kirste, A., et al., "Anodic Phenol-Arene Cross-Coupling Reaction on Boron-Doped Diamond Electrodes," Angew. Chem. Int. Ed., vol. 49, No. 5, pp. 971-975, (Dec. 22, 2009) XP002595230.
International Search Report Issued Aug. 19, 2010 in PCT/EP10/057617 Filed Jun. 1, 2010.
U.S. Appl. No. 13/375,100, filed Nov. 29, 2011, Stecker, et al.

* cited by examiner

*Primary Examiner* — Edna Wong
(74) *Attorney, Agent, or Firm* — Oblon, Spivak, McClelland, Maier & Neustadt, L.L.P.

(57) ABSTRACT

The invention relates to a process for preparing biaryls by anodic cross-dehydrodimerization of substituted phenols with arenes in the presence of partially fluorinated and/or perfluorinated mediators and a supporting electrolyte.

19 Claims, No Drawings

PROCESS FOR THE ANODIC CROSS-DEHYDRODIMERIZATION OF ARENES

CROSS REFERENCE TO RELATED APPLICATION

This application is a National Stage entry under 35 USC 371 of PCT/EP10/057,617, filed on Jun. 1, 2010, and claims priority to European Patent Application No. 09162074.0, filed on Jun. 5, 2009.

The invention relates to a process for preparing biaryls by anodic cross-dehydrodimerization of substituted phenols with arenes in the presence of partially fluorinated and/or perfluorinated mediators and a supporting electrolyte.

The oxidative cross-coupling of arenes is a field of research of high current importance and has been described by (a) L. J. Goossen, G. Deng, Guojun, L. M. Levy, in Science 2006, 313, 662; by D. R. Stuart, K. Fagnou, in Science 2007, 316, 1172; by A. Jean, J. Cantat, D. Birard, D. Bouchu, S. Canesi, in Org. Lett. 2007, 9, 2553; by R. Li, L. Jiang, W. Lu, in Organometallics 2006, 25, 5973; by A. Timothy, N. R. Dwight, D. C. Dagmara, J. Ryan, D. Brenton, in Org. Lett. 2007, 9, 3137, and by K. L. Hull, M. S. Sanford, in J. Am. Chem. Soc. 2007, 129, 11904. However, electrochemical processes have not been described hitherto in this context despite numerous potential advantages.

The general strategy of the oxidative cross-coupling of arenes utilizes the reactivity of a reagent with one component (A) of the coupling partners (A and B) to form an intermediate (I). In the next step, the other component (B) is attacked by the intermediate (I) generated. Hitherto, the commencement of the reaction sequence on the first component (A) was made possible by specific neighboring groups which allow the insertion of a strongly oxidizing metal ion such as $Pd^{2+}$ into a CH bond. The subsequent cross-coupling is usually with halogen-substituted reaction partners (B). The specific reactivity of indoles and fluorinated arenes toward transition metals can also be utilized for such a transformation. In contrast, hypervalent iodine compounds such as PIFA (phenyliodine bis(trifluoroacetate)) and derivatives can, after activation with a Lewis acid, coordinate to a rr system and thus initiate the reaction sequence by electron transfer, as described by T. Dohi, Motoki Ito, K. Morimoto, M. Iwata, Y. Kita, in Angew. Chem. 2008, 120, 1321; and in Angew. Chem. Int. Ed. 2008, 47, 3787. Disadvantages of both approaches are that in each case only a very limited substrate range can be reacted and a relatively large amount of usually toxic waste is generated in the transformation. In addition, the reagents are expensive.

Oxidative cross-couplings of phenols with anilines or other electron-rich aromatic components can in few cases be achieved either by means of particular Lewis acid additives, as described by G. Satori, R. Maggi, F. Bigi, A. Arienti, G. Casnati, in Tetrahedron, 1992, 43, 9483, or by prior cocrystallization. In the latter example, preorganization via hydrogen bond formation takes place, as described by M. Smrcina, S. Vyskocil, A. B. Abbott, P. Kocovsky, in J. Org. Chem. 1994, 59, 2156; by K. Ding, Q. Xu, Y. Wang, J. Liu, Z. Yu, B. Du, Y. Wu, H. Koshima, T. Matsuura, in J. Chem. Soc., Chem. Commun. 1997, 693, and by S. Vyskocil, M. Smrcina, B Maca, M. Polasek, T. A. Claxton, A. B. Abbott, P. Kocovsky, in J. Chem. Soc., Chem. Commun. 1998, 586.

It has been able to be shown that symmetrical phenol coupling at boron-doped diamond (BDD) electrodes can be achieved using supporting electrolytes, as described by A. Kirste, M. Nieger, I. M. Malkowsky, F. Stecker, A. Fischer, S. R. Waldvogel, Chem. Eur. J. 2009, 15, 2273, and in WO 2006/077204. A selective and efficient biphenol coupling of, for example, 2,4-dimethylphenol can be achieved using other carbon electrodes and fluorinated carboxylic acids as mediators. The solvent-free process requires only undivided electrolysis cells, as has been described by A. Fischer, I. M. Malkowsky, F. Stecker, A. Kirste, S. R. Waldvogel in Anodic Preparation of Biphenols on BDD electrodes and EP 08163356.2.

It is an object of the present invention to provide a process which makes anodic cross-dehydrodimerization of substituted aryl alcohols with arenes possible without expensive catalysts and compounds having specific leaving groups having to be used and without toxic waste products being generated.

This object is achieved by a process for preparing biaryls, wherein substituted aryl alcohols are anodically dehydrodimerized with arenes in the presence of partially fluorinated and/or perfluorinated mediators and at least one supporting electrolyte to form the cross-coupling products.

The process of the invention is advantageous when the OH group of the aryl alcohols used is bound directly to the aromatic.

The process of the invention is advantageous when the substituted aryl alcohols used can be monocyclic or bicyclic.

The process of the invention is advantageous when the substituted arenes used can be monocyclic or bicyclic.

The process of the invention is advantageous when the dimerization takes place in the ortho position relative to the alcohol group of the aryl alcohol.

The process of the invention is advantageous when the mediators used are partially fluorinated and/or perfluorinated alcohols and/or acids.

The process of the invention is advantageous when 1,1,1,3,3,3-hexafluoroisopropanol and/or trifluoroacetic acid are used as mediators.

The process of the invention is advantageous when salts selected from the group consisting of alkali metal, alkaline earth metal, tetra($C_1$-$C_6$-alkyl)ammonium salts are used as supporting electrolytes.

The process of the invention is advantageous when the counterions of the supporting electrolytes are selected from the group consisting of sulfate, hydrogensulfate, alkyl-sulfates, arylsulfates, halides, phosphates, carbonates, alkylphosphates, alkyl-carbonates, nitrate, alkoxides, tetrafluoroborate, hexafluorophosphate and perchlorate.

The process of the invention is advantageous when no further solvent is used for the electrolysis.

The process of the invention is advantageous when a diamond anode and a nickel cathode are used.

The process of the invention is advantageous when the diamond electrode is a boron-doped diamond electrode.

The process of the invention is advantageous when a flow cell is used for the electrolysis.

The process of the invention is advantageous when current densities of from 1 to 1000 $mA/cm^2$ are used.

The process of the invention is advantageous when the electrolysis is carried out at temperatures in the range from −20 to 100° C. and atmospheric pressure.

The process of the invention is advantageous when 4-methylguaiacol is used as aryl alcohol.

For the purposes of the present invention, an aryl alcohol is an aromatic alcohol in which the hydroxyl group is bound directly to the aromatic ring.

The aromatic on which the aryl alcohol is based can be monocyclic or polycyclic. The aromatic is preferably monocyclic (phenol derivatives) as per formula I or bicyclic (naphthol derivatives) as per formula II or III, in particular monocyclic. Furthermore, an $sp^2$-hybridized ring carbon of the aromatic on which the aryl alcohol is based can be replaced by a nitrogen atom (pyridine, quinoline or isoquinoline derivative).

I

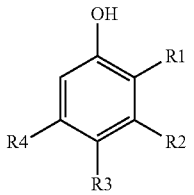

II

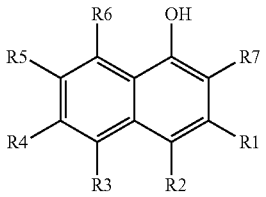

III

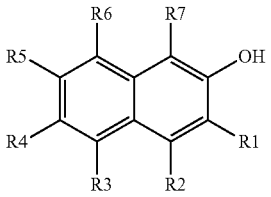

The aryl alcohols can also bear further substituents R1 to R7. These substituents R1 to R7 are selected independently from the group consisting of $C_1$-$C_{10}$-alkyl groups, halogens, hydroxy, $C_1$-$C_{10}$-alkoxy groups, alkylene or arylene radicals interrupted by oxygen or sulfur, $C_1$-$C_{10}$-alkoxycarboxyl, amino, nitrile, nitro and $C_1$-$C_{10}$-alkoxy-carbamoyl. The substituents R1 to R7 are preferably selected from the group consisting of methyl, ethyl, n-propyl, isopropyl, n-butyl, trifluoromethyl, fluorine, chlorine, bromine, iodine, hydroxy, methoxy, ethoxy, methylene, ethylene, propylene, isopropylene, benzylidene, amino, nitrile, nitro. The substituents R1 to R7 are particularly preferably selected from the group consisting of methyl, methoxy, methylene, ethylene, trifluoromethyl, fluorine and bromine. Very particular preference is given to 4-alkyl- and 2,4-dialkyl-substituted phenols.

Suitable substrates for the electrodimerization according to the present invention are in principle all arenes which on the basis of their three-dimensional structure and steric requirements are capable of cross-dehydrodimerization. For the purposes of the present invention, arenes are aromatic carbon compounds and heteroaromatics. Preference is given to carbon compounds and heteroaromatics of the general formulae IV to VIII. The aromatic on which the arene is based can be monocyclic or polycyclic. The aromatic is preferably monocyclic (benzene derivatives) or bicyclic (naphthalene derivatives), in particular monocyclic. The arenes can also bear further substituents. Preferred arenes are those of the formulae IV to VIII. Furthermore, an $sp^2$-hybridized ring carbon of the arenes of the formulae IV and V can be replaced by a nitrogen atom (pyridine, quinoline or isoquinoline derivative).

IV

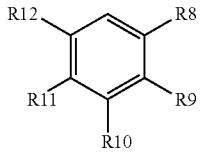

V

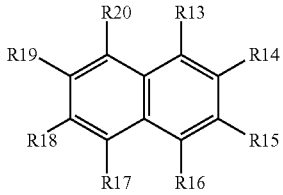

VI

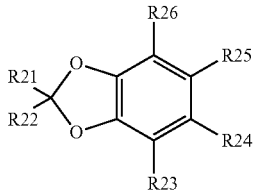

VII

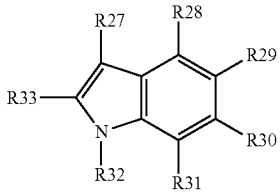

VIII

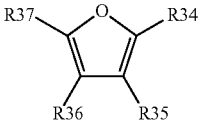

These bear substituents R8 to R37 which are selected independently from the group consisting of $C_1$-$C_{10}$-alkyl groups, halogens, hydroxy, $C_1$-$C_{10}$-alkoxy groups, alkylene or arylene radicals interrupted by oxygen or sulfur, $C_1$-$C_{10}$-alkoxycarboxyl, amino, nitrile, nitro and $C_1$-$C_{10}$-alkoxycarbamoyl radicals. The substituents are preferably selected from the group consisting of methyl, ethyl, n-propyl, isopropyl, n-butyl, trifluoromethyl, fluorine, chlorine, bromine, iodine, hydroxy, methoxy, ethoxy, methylene, ethylene, propylene, isopropylene, benzylidene, amino, nitrile, nitro. The substituents are particularly preferably selected from the group consisting of methyl, methoxy, methylene, ethylene, trifluoromethyl, fluorine and bromine. Very particular preference is given to arenes selected from the group consisting of monosubstituted or polysubstituted benzene derivatives, monosubstituted or polysubstituted naphthalene derivatives, monosubstituted or polysubstituted benzodioxole derivatives, monosubstituted or polysubstituted furan derivatives, monosubstituted or polysubstituted indole derivatives.

The biaryl is produced electrochemically, with the corresponding aryl alcohol being anodically oxidized. The process of the invention will hereinafter be referred to as electrodimerization. It has surprisingly been found that the process of the invention using mediators forms the biaryls selectively and in high yield. Furthermore, it has been found that undivided cell constructions and solvent-free processes can be employed in the process of the invention.

The work-up and isolation of the desired biaryls is very simple. After the reaction is complete, the electrolyte solution is worked up by general separation methods. For this purpose, the electrolyte solution is in general firstly distilled and the individual compounds are obtained separately in the form of various fractions. Further purification can be carried out, for example, by crystallization, distillation, sublimation or chromatography.

The process of the invention is carried out using a diamond electrode. These diamond electrodes are formed by applying one or more diamond layers to a support material. Possible support materials are niobium, silicon, tungsten, titanium, silicon carbide, tantalum, graphite or ceramic supports such as titanium suboxide. However, a support composed of niobium, titanium or silicon is preferred for the process of the invention, and very particular preference is given to a support composed of niobium.

Electrodes selected from the group consisting of iron, steel, stainless steel, nickel, noble metals such as platinum, graphite, carbon materials such as the diamond electrodes are suitable for the process of the invention. Suitable anode materials are, for example, noble metals such as platinum or metal oxides such as ruthenium or chromium oxide or mixed oxides of the $RuO_xTiO_x$ type and also diamond electrodes. Preference is given to graphite, carbon, vitreous carbon or diamond electrodes, particularly preferably diamond electrodes. A diamond electrode doped with further elements is preferred for the anode. As doping elements, preference is given to boron and nitrogen. The process of the invention is very particularly preferably carried out using a boron-doped diamond electrode (BDD electrode) as anode.

The cathode material is selected from the group consisting of iron, steel, stainless steel, nickel, noble metals such as platinum, graphite, carbon, vitreous carbon materials and diamond electrodes. The cathode is preferably selected from the group consisting of nickel, steel and stainless steel. The cathode is particularly preferably composed of nickel.

In the process of the invention, partially fluorinated and/or perfluorinated alcohols and/or acids, preferably perfluorinated alcohols and carboxylic acids, very particularly preferably 1,1,1,3,3,3-hexafluoroisopropanol or trifluoroacetic acid, are used as mediators.

No further solvents are necessary in the electrolyte.

The electrolysis is carried out in the customary electrolysis cells known to those skilled in the art. Suitable electrolysis cells are known to those skilled in the art. The process is preferably carried out continuously in undivided flow cells or batchwise in glass beaker cells.

Very particularly suitable cells are bipolar capillary cells or stacked plate cells in which the electrodes are configured as plates and are arranged in parallel, as described in Ullmann's Encyclopedia of Industrial Chemistry, Electrochemistry, 1999 electronic release, Sixth Edition, Wiley-VCH Weinheim (doi: 10.1002/14356007.a09_183.pub2) and in Electrochemistry, Chapter 3.5. special cell designs and also Chapter 5, Organic Electrochemistry, Subchapter 5.4.3.2 Cell Design.

The current densities at which the process is carried out are generally 1-1000 mA/cm$^2$, preferably 5-100 mA/cm$^2$. The temperatures are usually from −20 to 100° C., preferably from 10 to 60° C. The process is generally carried out at atmospheric pressure. Higher pressures are preferably employed when the process is to be carried out at higher temperatures in order to avoid boiling off the starting compounds or cosolvents or mediators.

To carry out the electrolysis, the aryl alcohol compound and the arene are dissolved in a suitable solvent. Suitable solvents are the customary solvents known to those skilled in the art, preferably solvents from the group consisting of polar protic and polar aprotic solvents. The aryl alcohol compound itself particularly preferably serves as solvent and reagent.

Examples of polar aprotic solvents comprise nitriles, amides, carbonates, ethers, ureas, chlorinated hydrocarbons. Examples of particularly preferred polar aprotic solvents comprise acetonitrile, dimethylformamide, dimethyl sulfoxide, propylene carbonate and dichloromethane. Examples of polar protic solvents comprise alcohols, carboxylic acids and amides. Examples of particularly preferred polar protic solvents comprise methanol, ethanol, propanol, butanol, pentanol and hexanol. These can also be partially or fully halogenated, e.g. 1,1,1,3,3,3-hexafluoroisopropanol (HFIP) or trifluoroacetic acid (TFA).

If appropriate, customary cosolvents are added to the electrolysis solution. These are the inert solvents having a high oxidation potential which are customary in organic chemistry. Examples which may be mentioned are dimethyl carbonate, propylene carbonate, tetrahydrofuran, dimethoxyethane, acetonitrile and dimethylformamide.

Supporting electrolytes which are comprised in the electrolysis solution are in general alkali metal, alkaline earth metal, tetra($C_1$-$C_6$-alkyl)ammonium, preferably tri($C_1$-$C_6$-alkyl)methylammonium, salts. Possible counterions are sulfates, hydrogensulfates, alkylsulfates, arylsulfates, halides, phosphates, carbonates, alkylphosphates, alkyl-carbonates, nitrate, alkoxides, tetrafluoroborate, hexafluorophosphate or perchlorate. Furthermore, the acids derived from the above-mentioned anions are possible as supporting electrolytes.

Very particular preference is given to methyltributylammonium methylsulfate (MTBS), methyltriethylammonium methylsulfate (MTES), methyltripropylmethylammonium methylsulfate or tetrabutylammonium tetrafluoroborate (TBABF).

EXAMPLES

Example 1

Anodic Oxidation of 4-methylguaiacol and Substituted Benzenes at a BDD Anode Using Hexafluoroisopropanol

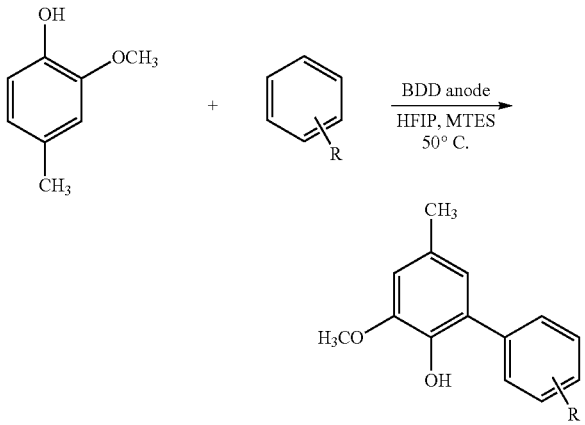

The electrolyte comprising substituted benzene and 4-methylguaiacol in a molar ratio of 10:1 as per table 1, 0.68 g of methyltriethylammonium methylsulfate (MTES) and 30 ml of hexafluoroisopropanol is placed in an electrolysis cell which is applied via a flange to a BDD-coated silicon plate and is connected as anode. The anode surface is completely covered with electrolyte. As cathode, use is made of a nickel mesh which is immersed in the electrolyte at a distance of 1 cm from the BDD anode. The cell is heated in a sand bath (50° C.). The electrolysis is carried out with galvanostatic control and at a current density of 4.7 mA/cm$^2$. The reaction is stopped after the set charging limit (1 F per mole of 4-methylguaiacol) has been reached. The cooled reaction mixture is transferred with the aid of about 20 ml of toluene into a flask from which toluene and the fluorinated solvent used are virtually completely removed on a rotary evaporator. Excess reactants can be recovered by means of short-path distillation under subatmospheric pressure. Purification of the distillation residue by column chromatography on silica gel 60 and subsequent washing with a little cold n-heptane enables the product to be isolated as a colorless, crystalline solid.

Analytical data for the cross-coupling products

2-Hydroxy-2',3-dimethoxy-5,5'-dimethylbiphenyl:

H NMR (400 MHz, $CDCl_3$) δ=7.16-7.11 (m, 2H), 6.91 (d, J=8.3, 1H), 6.72 (d, J=1.7, 1H), 6.68 (d, J=1.8, 1H), 5.89 (s, 1H), 3.91 (s, 4H), 3.82 (s, 4H), 2.33 (s, 8H); $^{13}$C NMR (101 MHz, $CDCl_3$) δ=154.14, 147.34, 140.90, 132.40, 130.42, 129.29, 129.16, 126.80, 125.58, 123.47, 111.40, 111.38, 56.15, 55.99, 49.43, 21.12, 20.46.

2-Hydroxy-2',3,5'-trimethoxy-5-methylbiphenyl:

$^1$H NMR (400 MHz, $CDCl_3$) δ=6.89-6.79 (m, 3H), 6.65 (d, J=1.7, 1H), 6.62 (d, J=1.6, 1H), 5.90 (s, 1H), 3.83 (s, 3H), 3.72 (s, 6H), 2.25 (s, 3H); $^{13}$C NMR (101 MHz, $CDCl_3$) δ=153.95, 150.45, 147.44, 140.90, 129.27, 128.12, 125.36, 123.34, 117.25, 113.89, 112.88, 111.54, 56.81, 56.00, 55.74, 21.13.

2-Hydroxy-3,4'-dimethoxy-3',5-dimethylbiphenyl:

$^1$H NMR (500 MHz, $CDCl_3$) δ=7.43 (dd, J=2.3, 8.4, 1H), 7.39 (d, J=2.0, 1H), 6.91 (d, J=8.4, 1H), 6.77 (d, J=1.8, 1H), 6.68 (d, J=1.7, 1H), 5.67 (s, 1H), 3.92 (s, 4H), 3.88 (s, 4H), 2.35 (s, 4H), 2.29 (s, 4H); $^{13}$C NMR (126 MHz, $CDCl_3$) δ=156.95, 146.54, 140.33, 131.41, 129.75, 128.88, 127.48, 127.20, 126.29, 122.73, 110.17, 109.69, 56.08, 55.32, 21.10, 16.31.

2-Hydroxy-2',3,4',6'-tetramethoxy-5-methylbiphenyl:

$^1$H NMR (300 MHz, $CDCl_3$) δ=6.68 (d, J=1.8, 1H), 6.60 (d, J=1.9, 1H), 6.25 (s, 2H), 5.37 (s, 1H), 3.89 (s, 3H), 3.86 (s, 3H), 3.75 (s, 6H), 2.32 (s, 3H); $^{13}$C NMR (75 MHz, CDCl3) δ=161.01, 158.70, 146.61, 141.24, 128.29, 124.62, 120.40, 111.02, 107.48, 91.16, 56.06, 55.76, 55.32, 21.22; HRMS: m/e calculated for $C_{17}H_{20}O_5$: 304.1311, found: 304.1307; MS (EI): m/z (%): 304.1 (100), 289.1 (8), 273.1 (32), 258.1 (25), 229.1 (8), 181.1 (8), 168.1 (26), 151.0 (7), 139.0 (17), 122.0 (15), 97.0 (6), 83.0 (7), 71.0 (7), 57.0 (12).

2-Hydroxy-2',3,4',5'-tetramethoxy-5-methylbiphenyl:

$^1$H NMR (300 MHz, $CDCl_3$) δ=6.77 (s, 1H), 6.63 (d, J=1.7, 1H), 6.61 (d, J=1.8, 1H), 6.57 (s, 1H), 5.86 (s, 1H), 3.85 (s, 4H), 3.82 (s, 4H), 3.77 (s, 4H), 3.72 (s, 4H), 2.25 (s, 4H); $^1$H NMR (300 MHz, $CDCl_3$) δ=6.77, 6.62, 6.61, 6.61, 6.57, 5.86, 3.85, 3.82, 3.77, 3.72, 2.25.

2-Hydroxy-2',3,3',4'-tetramethoxy-5,6'-dimethylbiphenyl $^1$H NMR (400 MHz, $CDCl_3$) δ=6.70 (d, J=1.6, 1H), 6.62 (s, 1H), 6.52 (d, J=1.7, 1H), 5.44 (s, 1H), 3.91 (s, 3H), 3.89 (s, 3H), 3.88 (s, 3H), 3.68 (s, 3H), 2.32 (s, 3H), 2.06 (s, 3H); $^{13}$C NMR (101 MHz, $CDCl_3$) δ=152.49, 151.62, 146.35, 140.72, 140.05, 132.69, 128.67, 123.89, 123.63, 123.28, 110.65, 108.92, 60.98, 60.86, 55.85, 55.81, 21.15, 20.00.

5'-Bromo-2-hydroxy-2',3,4'-trimethoxy-5-methylbiphenyl:

$^1$H NMR (300 MHz, $CDCl_3$) δ=7.46 (s, 1H), 6.70 (d, J=1.7, 2H), 6.64 (d, J=1.8, 2H), 6.59 (s, 2H), 5.28 (s, 1H), 3.95 (s, 5H), 3.90 (s, 5H), 3.84 (s, 5H), 2.32 (s, 5H); $^{13}$C NMR (75 MHz, $CDCl_3$) δ=156.83, 156.13, 146.84, 140.90, 135.15, 129.03, 123.49, 123.46, 120.78, 111.23, 102.30, 97.08, 56.37, 56.31, 55.97, 21.07.

TABLE 1

Reaction of 4-methylguaiacol with substituted benzenes at BDD using HFIP.

| Electrolyte | T [° C.] | $U_{max}$ [V] | F [1/mol] | j [mA/cm$^2$] | Y$^b$ [%] (No.) | CY [%] |
|---|---|---|---|---|---|---|
| 3.05 g of 4-methylanisole/ 0.36 g of 4-methylguaiacol/ 0.68 g of MTES/30 ml of HFIP | 50 | 6 | 1.0 | 4.7 | 5 (3) | 7 |
| 6.91 g of 4-methoxyanisole/ 0.69 g of 4-methylguaiacol/ 0.68 g of MTES/30 ml of HFIP | 50 | 8 | 1.0 | 4.7 | 2 (4) | 4 |
| 6.11 g of 2-methylanisole/ 0.69 g of 4-methylguaiacol/ 0.68 g of MTES/30 ml of HFIP | 50 | 7 | 1.0 | 4.7 | 4 (5) | 9 |
| 8.43 g of 1,3,5-trimethoxy-benzene/ 0.69 g of 4-methylguaiacol/ 0.68 g of MTES/30 ml of HFIP | 50 | 5 | 1.0 | 4.7 | 12 (2) | 23 |
| 8.43 g of 1,2,4-trimethoxy-benzene 0.69 g of 4-methylguaiacol/ 0.68 g of MTES/30 ml of HFIP | 50 | 10 | 1.0 | 4.7 | 17 (6) | 34 |
| 4.74 g of 1,2,3-trimethoxy-5-methylbenzene/ 0.36 g of 4-methylguaiacol/ 0.68 g of MTES/30 ml of HFIP | 50 | 6 | 1.0 | 4.7 | 11 (8) | 23 |
| 10.85 g of 1-bromo-2,4-di-methoxybenzene/ 0.69 g of 4-methylguaiacol/ 0.68 g of MTES/30 ml of HFIP | 50 | 7 | 1.0 | 4.7 | 18 (7) | 37 |

$^b$Based on 4-methylguaiacol used.

Y: Yield

CY: Current yield

The invention claimed is:

1. A process for preparing a biaryl, the process comprising:

anodically dehydrodimerizing (a) a substituted aryl alcohol comprising an alcohol group bound directly to an aromatic ring, with (b) an arene, in the presence of at least one mediator selected from the group consisting of a partially fluorinated mediator and a perfluorinated mediator, and a supporting electrolyte, to obtain a cross-coupling product, wherein the arene is a monosubstituted or polysubstituted benzene derivative, monosubstituted or polysubstituted naphthalene derivative, monosubstituted or polysubstituted benzodioxole derivative, monosubstituted or polysubstituted furan derivative, or monosubstituted or polysubstituted indole derivative, and each substituent of the arene is independently selected from the group consisting of methyl, ethyl, n-propyl, isopropyl, n-butyl, trifluoromethyl, fluorine, chlorine, bromine, iodine, methoxy, ethoxy, methylene, ethylene, propylene, isopropylene, benzylidene, amino, nitrile, and nitro.

2. The process of claim 1, wherein the substituted aryl alcohol is monocyclic.

3. The process of claim 1, wherein the arene is monocyclic.

4. The process of claim 1, wherein the dehydrodimerizing takes place in an ortho position relative to the alcohol group of the substituted aryl alcohol.

5. The process of claim 1, wherein the mediator is at least one mediator selected from the group consisting of a partially fluorinated alcohol, a perfluorinated alcohol, a partially fluorinated acid, and a perfluorinated acid.

6. The process of claim 1, wherein the mediator is 1,1,1,3,3,3-hexafluoroisopropanol.

7. The process of claim 1, wherein the supporting electrolyte is at least one supporting electrolyte selected from the group consisting of an alkali metal salt, an alkaline earth metal salt, and a tetra($C_1$-$C_6$-alkyl)ammonium salt.

8. The process of claim 1, wherein a counterion of the supporting electrolyte is at least one counterion selected from the group consisting of sulfate, hydrogensulfate, an alkylsulfate, an arylsulfate, a halide, a phosphate, a carbonate, an alkylphosphate, an alkylcarbonate, nitrate, an alkoxide, tetrafluoroborate, hexafluorophosphate, and perchlorate.

9. The process of claim 1, wherein no further solvent is employed for the dehydrodimerizing.

10. The process of claim 1, wherein a diamond anode and a nickel cathode are employed for the dehydrodimerizing.

11. The process of claim 1, wherein a diamond electrode is employed for the dehydrodimerizing, said diamond electrode comprising a boron-doped diamond electrode.

12. The process of claim 1, wherein the dehydrodimerizing is performed in a flow cell.

13. The process of claim 1, wherein a current density of from 1 to 1000 $mA/cm^2$ is employed in the dehydrodimerizing.

14. The process of claim 1, wherein the dehydrodimerizing is carried out at a temperature in a range from −20 to 100° C. and at atmospheric pressure.

15. The process of claim 1, wherein the substituted aryl alcohol is 4-methylguaiacol.

16. The process of claim 1, wherein the substituted aryl alcohol is bicyclic.

17. The process of claim 1, wherein the arene is bicyclic.

18. The process of claim 1, wherein the mediator is trifluoroacetic acid.

19. The process of claim 1, wherein the mediator comprises 1,1,1,3,3,3-hexafluoroisopropanol and trifluoroacetic acid.

* * * * *